US007128318B2

(12) United States Patent
Loiselle

(10) Patent No.: US 7,128,318 B2
(45) Date of Patent: Oct. 31, 2006

(54) SHEET REGISTRATION DESKEW IMPROVEMENT SYSTEM WITH A CENTRALLY PIVOTAL BAFFLE

(75) Inventor: Joseph Andre Michel Loiselle, Brampton (CA)

(73) Assignee: Xerox Corporation, Stamford, CT (US)

( * ) Notice: Subject to any disclaimer, the term of this patent is extended or adjusted under 35 U.S.C. 154(b) by 445 days.

(21) Appl. No.: 10/827,865

(22) Filed: Apr. 20, 2004

(65) Prior Publication Data

US 2005/0230906 A1 Oct. 20, 2005

(51) Int. Cl.
*B65H 9/04* (2006.01)

(52) U.S. Cl. ..... 271/245; 271/234; 271/242

(58) Field of Classification Search ..... 271/226, 271/227, 234, 242, 245, 246
See application file for complete search history.

(56) References Cited

U.S. PATENT DOCUMENTS

| | | | | |
|---|---|---|---|---|
| 3,281,144 | A | 10/1966 | Turner et al. | |
| 3,601,392 | A | 8/1971 | Spear, Jr. et al. | |
| 3,614,095 | A * | 10/1971 | Beck et al. | 271/280 |
| 4,247,095 | A * | 1/1981 | May | 271/233 |
| 4,262,895 | A * | 4/1981 | Wenthe, Jr. | 271/65 |
| 5,246,224 | A * | 9/1993 | Matsuno et al. | 271/242 |
| 5,596,399 | A * | 1/1997 | Dempsey et al. | 399/45 |
| 5,692,744 | A * | 12/1997 | Funato | 271/242 |
| 5,775,690 | A * | 7/1998 | Quesnel et al. | 271/242 |
| 5,795,087 | A * | 8/1998 | Brower et al. | 400/636 |
| 5,904,350 | A | 5/1999 | Creighton et al. | |
| 6,155,561 | A | 12/2000 | Mandel | |
| 6,584,900 | B1 * | 7/2003 | De Vroome | 101/228 |
| 6,585,439 | B1 * | 7/2003 | Johnson et al. | 400/642 |
| 6,805,347 | B1 * | 10/2004 | Kuramoto | 271/242 |
| 6,974,128 | B1 | 12/2005 | Quesnel | |
| 2004/0135310 | A1 * | 7/2004 | Yang | 271/226 |

FOREIGN PATENT DOCUMENTS

| | | | |
|---|---|---|---|
| JP | 61027855 | A * | 2/1986 |
| JP | 63082266 | A * | 4/1988 |
| JP | 03279143 | A * | 12/1991 |
| JP | 06064792 | A * | 3/1994 |
| JP | 2005306610 | A * | 11/2005 |

* cited by examiner

*Primary Examiner*—Patrick Mackey
*Assistant Examiner*—Matthew J. Kohner

(57) ABSTRACT

Sheet registration with improved sheet deskewing of print media sheets may be provided with an intermediately transversely pivotal baffle member overlying and engaging at least part of a buckled sheet being edge registered so that the effective buckle chamber size and sheet path length on one side of the sheet is automatically different from the other side of the sheet with said pivoting of said pivotal baffle member, to assist in the deskewing of the sheet as it is being partially buckled by the sheet registration system. The direction and amount of baffle pivoting may be self-pivoted by the extent of transverse buckle difference, or positively driven in response to a detected sheet skew.

9 Claims, 3 Drawing Sheets

SHEET REGISTRATION DESKEW IMPROVEMENT SYSTEM WITH A CENTRALLY PIVOTAL BAFFLE

This application is related to commonly owned Xerox U.S. application Ser. No. 10/458,415 filed Jun. 10, 2003 by Lisbeth S. Quesnel, entitled SHEET REGISTRATION DESKEW WITH PLURAL ARCUATE INDEPENDENTLY REPOSITIONABLE BAFFLES, now U.S. Pat. No. 6,974,128, issued Dec. 13, 2005.

Disclosed in the embodiment herein is an improved system for sheet registration in sheet registration systems in which an edge of a sheet in sheet movement path is partially buckled against a transversely extending portion of the registration system, wherein a centrally pivoted transversely pivotal control baffle extends over and variably engages the buckled area of the sheet being registered to automatically accommodate and help control skewed sheets being transversely variably buckled by the registration system in the sheet path to help provide improved deskewing alignment of the edge of the skewed sheets with the registration system.

By way of general background, various types of sheet registration systems are well known to those skilled in the art. A common sheet registration system in the sheet path of a printer or finisher is one in which the leading (movement direction) edge of the sheet is partially arcuately buckled against a transversely extending registration gate in the sheet path. As is well known, a registration gate may be variously provided by temporarily stalled or slower speed sheet feed roller nips, retractable fingers or pins, etc. Typically, the sheet to be registered is driven up against the registration gate and at least a forward area thereof slightly buckled thereagainst, until the lead edge of the sheet is fully aligned therewith. Then that registered sheet may released at the desired time or position, so as to be stacked, or further processed, such as subsequently fed on in the process direction to be printed with a desired registration relative to the print image, or stapled or otherwise finished.

The following patent disclosures are noted merely by way of some examples of how old this kind of low cost sheet buckling registration art is per se, even for xerographic printing sheet registration systems: Xerox Corp. U.S. Pat. No. 3,281,144, issued Oct. 25, 1966 and U.S. Pat. No. 3,601,392, issued Aug. 24, 1971.

Particularly noted as to prior art on movable sheet path baffles to control the sheet path is Xerox Corp. U.S. Pat. No. 6,155,561, issued Dec. 5, 2000 by Barry Mandel.

It has been found that attempting to drive a significantly skewed sheet into "hard stop" registration against fixed position relatively small area registration gate fingers, pins, or paddles has additional problems in a system in which the vertical sheet path spacing or height between the top and bottom of the sheet being registered (which defines the sheet buckle chamber) is fixed. A skewed sheet entering that kind of registration system with one transverse side of the skewed sheet then-leading edge leading the other side of that sheet's then leading edge, and thus impacting only one of those small area registration gate fingers or pins on only one side. That sheet edge impact force may be increased by the restricted sheet buckling height on that same side of the sheet. That can cause or increase sheet edge marks or damage in that sheet edge impact area. The disclosed embodiment can reduce this, and thus may also enable "on the fly" sheet hole punching, and/or reduce the need to stop and reverse sheets during registration and deskew in sheet or sheet sets finishing, even at faster printing rates with faster sheet path transport movement velocities.

Many desirably small footprint reproduction machine architectures desirably have compact paper paths. They may even desire or be constrained to place the sheet buckling areas for sheet registration including deskew in a curved (arcuate) section of the paper path. This can create additional problems in buckling a skewed sheet correctly into the registration system sheet lead edge transverse registration stopping system while the sheet is in such a constrained arcuate sheet path. However, even if sheet registration is being done in a planar sheet path section, it has been discovered that sheet deskewing problems, and/or limited tolerances for initial entering amounts of sheet skew, can be exacerbated by providing a single fixed buckle chamber of constant height or spacing transversely of the paper path, which may not provide for fully deskewing the lead edge of the sheet. A sheet entering the registration system with a substantial initial skew will normally buckle up much higher on the leading transverse side of the skewed sheet where the lead edge of that skewed sheet first engages the registration gate as compared to the other (trailing) side of the skewed sheet.

In contrast, in the illustrated exemplary embodiment herein, a centrally pivotable baffle is provided with opposite direction baffle movements from one transverse side of the sheet path relative to the other (inboard versus outboard), which enables and helps to control a skewed sheet being registered to buckle differently transversely (inboard versus outboard) for increased deskewing latitude.

Note that a deskewing sheet buckle can be formed adjacent the feed rollers of an upstream sheet feeding nip which is temporarily stopped or slowed to forming the registration gate, and that sheet feeding nip may then be restarted to feed the now-deskewed sheet downstream through that sheet feeding nip in the same direction. However, a deskewing sheet buckle can also be formed adjacent to the feed rollers of a then-downstream sheet feeding nip which is feeding out the trailing edge of a sheet while the lead edge of that same sheet is being registered and deskewed against a then-upstream registration gate (such as the retractable pins illustrated herein), which downstream sheet feeding nip can then reverse to reverse feed the now-deskewed sheet back through that nip in a direction opposite to its entry direction.

A specific feature of the specific embodiment disclosed herein is to provide a sheet edge registration system with improved sheet deskewing for flimsy print media sheets, in which a sheet moving in a sheet movement direction is partially buckled by at least one edge of said sheet engaging said registration system, wherein a transversely pivotal baffle member is pivotally mounted to overlie at least part of said buckled sheet being buckled by said sheet edge registration system and to at least partially define a sheet buckle chamber for said buckled sheet, said pivotal baffle member being intermediately pivotable about a pivot axis extending generally transversely of said sheet movement direction and generally intermediately of said sheet so as to provide a first side of said pivotal baffle member extending out over at least a substantial portion of one side of said sheet from one side of said pivot axis, and a second side of said baffle member extending out over at least a substantial portion of the opposing side of said sheet from the opposite side of said pivot axis, so that pivotal movement of said second side of said baffle member in a direction away from said sheet is automatically opposite from pivotal movement of said first side of said baffle member in a direction towards said sheet, so that the effective buckle chamber size and sheet path length on one side of said sheet is automatically different from the effective buckle chamber size and sheet path length on the other side of said sheet from said pivoting of said pivotal baffle member, so as to assist in the deskewing of said sheet being partially buckled by said sheet edge registration system.

Further specific features disclosed in the embodiment herein, individually or in combination, include those in which said pivotal baffle member is automatically pivoted in response to the buckling of one side of said sheet more than the buckling of other side of said sheet as said sheet is being partially buckled by said sheet edge registration system; and/or in which said pivotal baffle member is pivoted by a pivotal drive system controlled by a sheet skew detector; and/or in which said sheet edge registration system includes plural retractable fixed position sheet edge stop members extending transversely of said sheet movement direction; and/or in which said sheet edge registration system has plural retractable and extendable fixed position sheet edge stop members extending transversely of said sheet movement direction which are automatically retracted for initial movement of a sheet past said retractable fixed position sheet edge stop members and automatically extended to provide for the buckling of said sheet thereagainst by a reverse movement of said sheet; and/or a sheet registration method with improved sheet deskewing of print media sheets moving in a sheet movement direction wherein said sheet is buckled by engagement of at least one edge of said sheet with a sheet edge registration system, wherein a transversely pivotal baffle member is pivotally mounted to overlie at least a part of said partially buckled sheet being buckled against said sheet edge registration system, said pivotal baffle member being intermediately pivotable about a pivot axis extending generally transversely of said sheet movement direction and intermediately of said sheet to provide a first side of said pivotal baffle member extending out over at least a substantial portion of one side of said sheet from one side of said pivot axis, and a second side of said baffle member extending out over at least a substantial portion of the opposing side of said sheet from the opposite side of said pivot axis, so that pivotal movement of said second side of said baffle member in a direction away from said sheet is automatically opposite from pivotal movement of said first side of said baffle member in a direction towards said sheet, so that the effective buckle chamber size and sheet path length on one side of said sheet is automatically different from the effective buckle chamber size and sheet path length on the other side of said sheet from said pivoting of said pivotal baffle member, so as to assist in the deskewing of said sheet being partially buckled by said sheet edge registration system; and/or in which said baffle member is automatically pivoted by engagement with the buckling of the one side of said sheet which is more than the buckling of the other side of said sheet; and/or in which said baffle member is automatically pivoted by a pivotal drive system controlled by detection of the amount of skew of the sheet to be registered; and/or wherein said sheet edge registration system comprises plural retractable and extendable fixed position sheet edge stop members extending transversely of said sheet movement direction which are automatically retracted for initial movement of a sheet past said retractable fixed position sheet edge stop members and automatically extended for the buckling of said sheet edge thereagainst by a reverse movement of said sheet.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular components or systems illustrated herein are merely exemplary, and that the same novel motions and functions can be provided by many other known or readily available alternatives. For example, various upstream and downstream sheet feeding systems may be utilized with the system disclosed herein, and as they are well known to those in the art need not be described herein. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operations or methods described in the specific embodiments examples below, including the drawing figures (which are approximately to scale) wherein.

Figure 1:
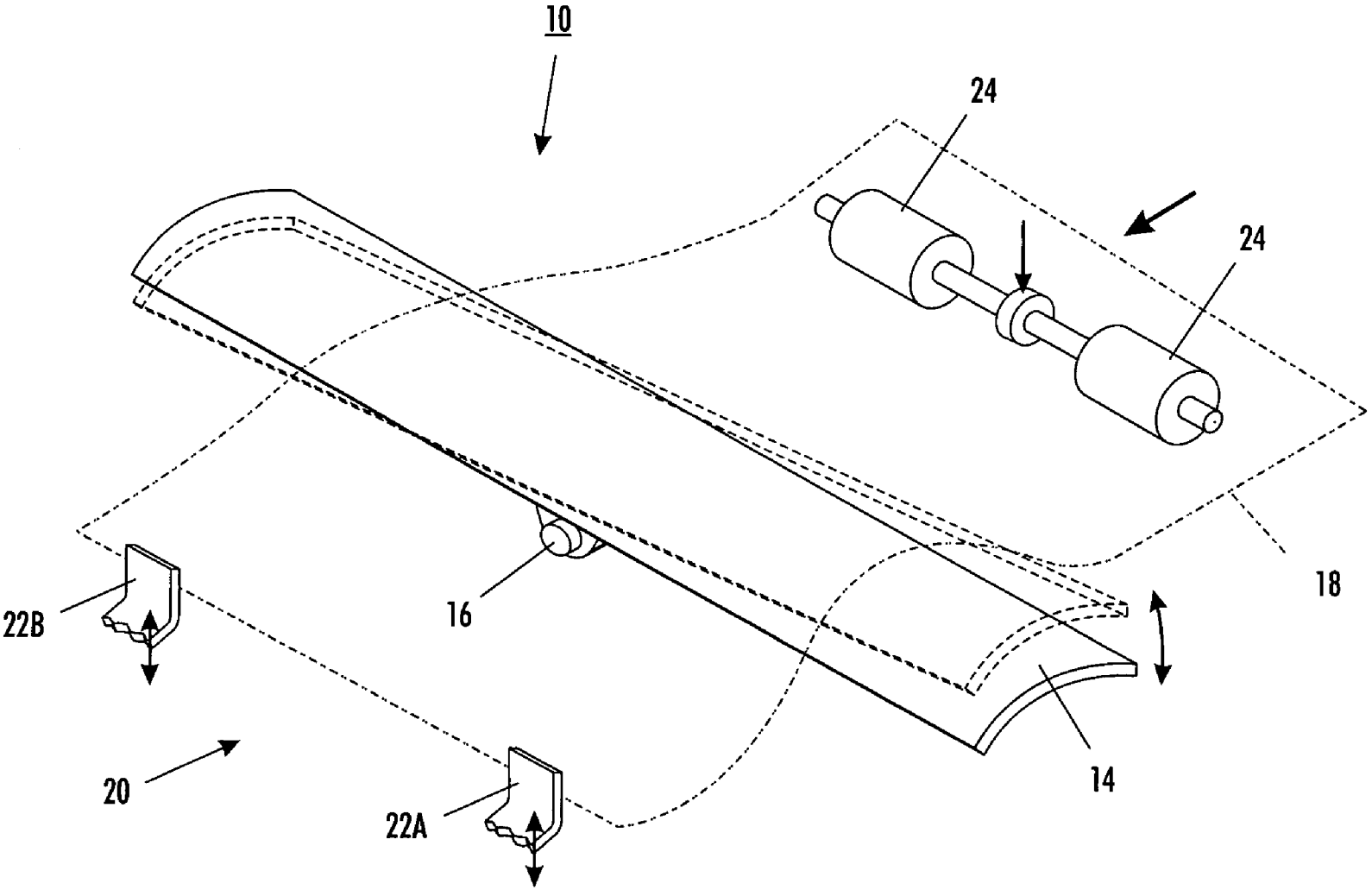
FIG. 1 is a perspective view of one example or embodiment of the subject improved deskewing sheet registration system, illustrating the pivotal movement of the centrally pivotal baffle member during registration of a skewed sheet with transverse difference in skewed sheet buckle height, in which a second embodiment is illustrated by the phantom view of an optional baffle tilting mechanism.

The disclosed embodiments of the Figures all show pivotal baffle system embodiments with a centrally pivotal baffle 14 pivotal about an axis 16 for a sheet 18 registration system 20 (including here retractable sheet edge stops or paddles 22A, 22B) with improved latitude sheet deskewing system, as more generally described above. They will be commonly described and reference numbered herein. The drawings have been simplified to remove conventional or unrelated other elements, such as the conventional planar underlying sheet path defining baffle on the other side of the sheet 18 from the baffle 14, and entrance and exit baffles for the baffle 14, as well be well understood by those of ordinary skill in this art. However, in the embodiment 10 of FIG. 1 the baffle 14 is self-pivoted by the buckling sheet 18 as a skewed sheet 18 is being registered, while in the alternative embodiment 12 of FIGS. 2 and 3 the baffle 14 is actively pivoted by a motor driven cam 30 or other positive baffle-tilting drive, which may be controlled by conventionally sensing the amount of skew of the sheet 18 as the sheet edge enters or arrives at the registration system 20, such as by conventional optical or other sheet lead edge sensors 22 and 24 and a conventional skew detection and control software programmed in a conventional printer controller 100, as shown schematically in FIG. 3.

The disclosed baffle 14 can centrally pivot transversely of the paper path, preferably generally along a pivot axis 16 corresponding generally to the center line of the paper path. This baffle 14 is designed to allow and/or control the sheet being registered to buckle by different amounts transversely of the paper path, to provide a resulting improvement in deskew performance during registration.

Referring now in further detail to the specific sheet registration system 20 embodiment illustrated in the Figures, there is shown a portion of an otherwise conventional sheet path of a printer or its finisher, which thus need not be described herein. Each sheet 18 in this example is being driven into a sheet buckling area by sheet feed rollers 24 in the sheet path. This sheet path portion of the registration system 20 in which the sheet buckle is formed may be defined here by conventional baffle or baffles surfaces for the top or bottom side of the sheet 18 which may be fixed, opposite from the pivotal baffle 14, which is spaced therefrom, engageable with the other (to or bottom) side of the sheet 18.

Figure 3:
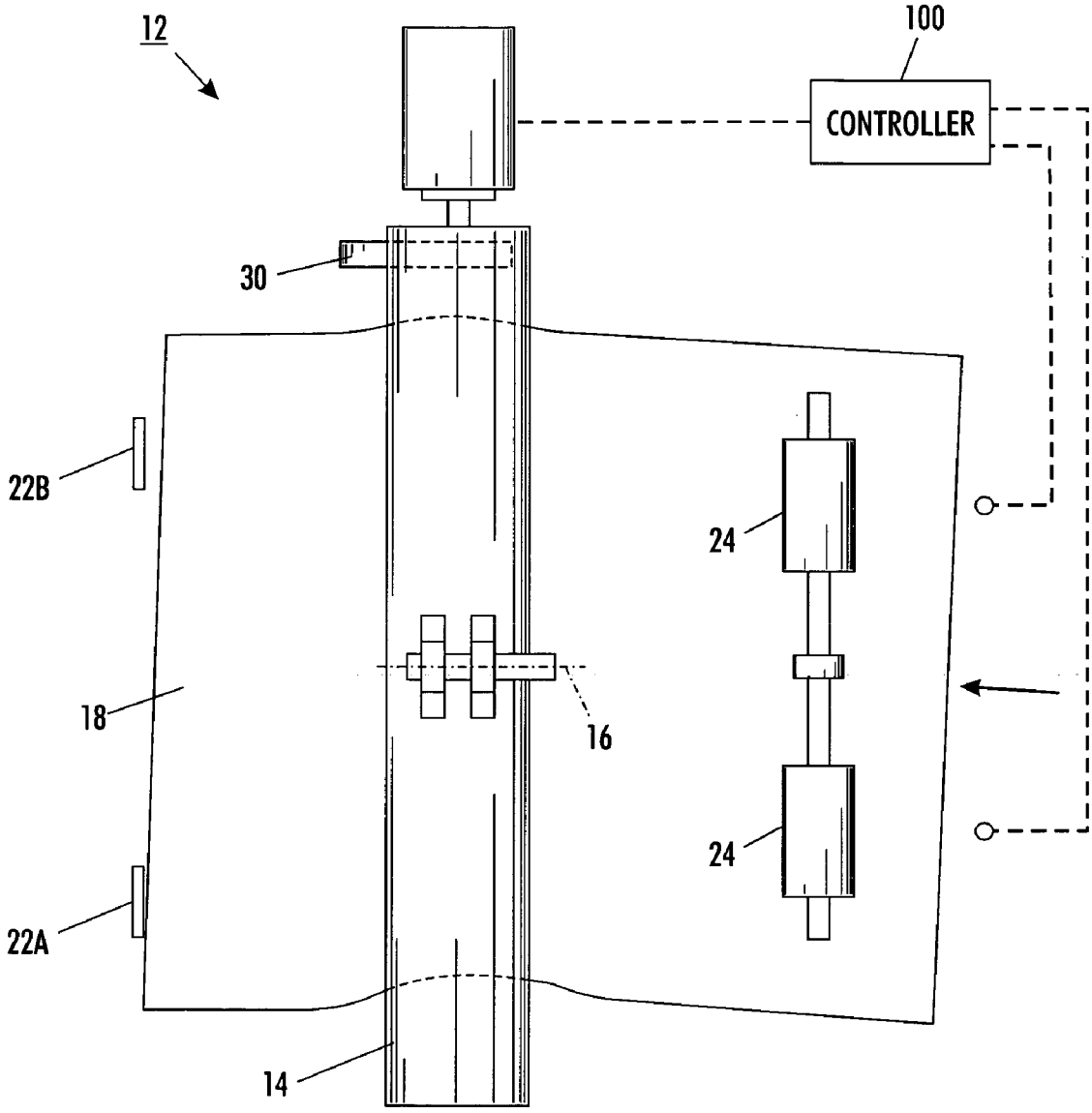
FIG. 3 is a top view of the embodiment of FIG. 2.

In the illustrated specific sheet registration system 20 embodiment (one of many different possible registration systems, as noted above), the then-leading edge of the sheet is being registered against plural retractable registration pins or paddles 22A and 22B which are extending into the sheet path to stop the forward movement of the sheet 18 lead edge at that point in time. The leading side of the then leading edge of the skewed sheet 18 will be the first part of the sheet 18 stopped by one of those stop members 22A or 22B on only one side of the sheet path. In FIG. 3 that is 22A. That causes a greater sheet buckle on that same transverse side of that sheet 18, as particularly illustrated in FIG. 1. That in turn causes or requires that same side of the pivotal baffle 14 to lift up more increasing the height of the buckle chamber and thus the allowable buckle height of that side of the sheet 18.

Figure 2:
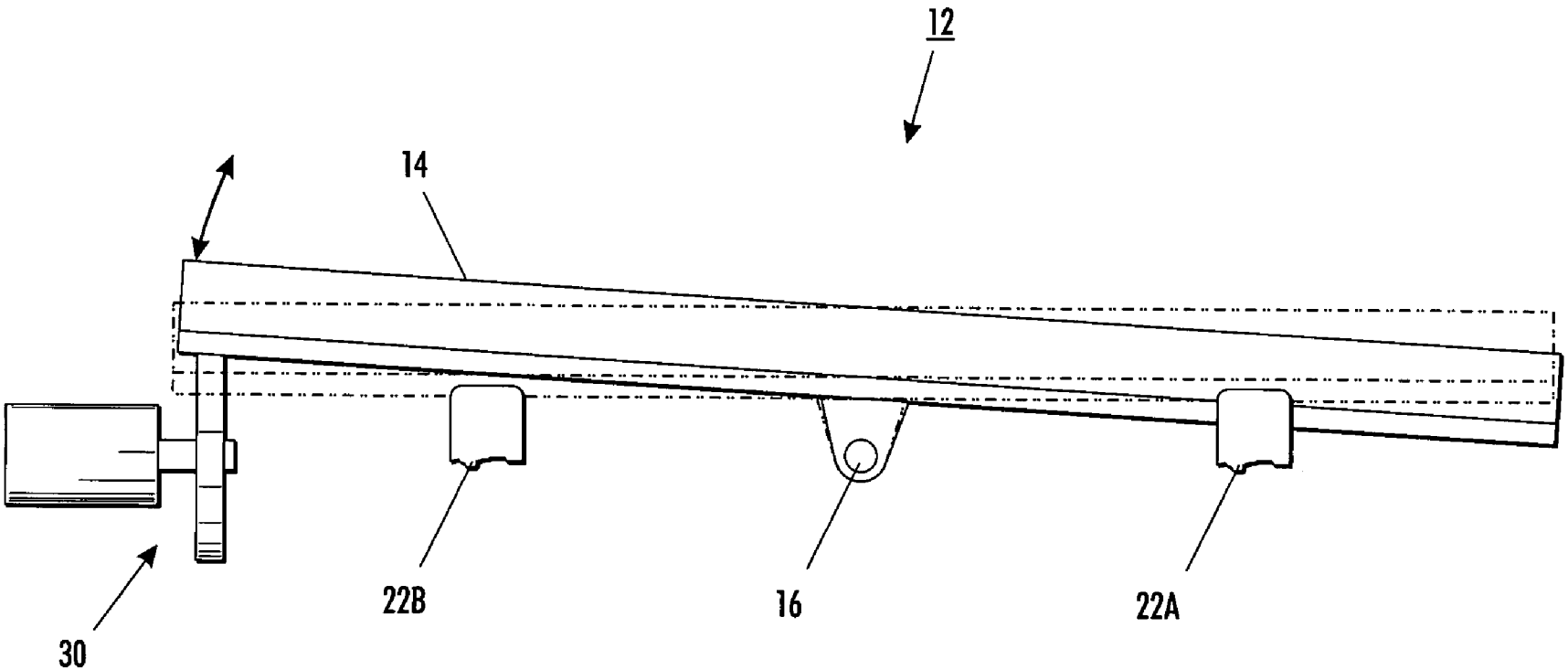
FIG. 2 is a frontal view similar to the exemplary system of FIG. 1, showing one baffle tilted position in solid lines and a non-tilted baffle position in dashed lines, but also showing a (rotatable cam) optional baffle tilting mechanism providing a second embodiment.

Raising that first side of the pivotable baffle 14, on one side of its axis of rotation 16, also immediately automatically lowers (and reduces the buckle chamber height) of the other, transverse, side of the baffle 14, as shown in both FIGS. 1 and 2. This pivotal movement of the baffle 14 can even press down on and thus help to push forward and rotate that other (trailing) side of the sheet to help it to engage the same registration gate (in FIG. 3 the pin or paddle 22B on the other side of the paper path) to help provide improved latitude sheet 18 deskewing.

Note that when the baffle 14 is pivoted out of the plane of the paper path, either by a sheet buckle acting on it as in the system 10 of FIG. 1, or pivoted by the cam drive 30 or otherwise as in the system 12 of FIGS. 2 and 3, that the effective sheet path length on one side of the paper path (the side with the larger buckle chamber) is longer than the effective sheet path length on the other side of the paper path in the sheet registration area. In the system 12, the direction (up or down) in which one side of the baffle is moved by the drive system 30 also corresponds to the sensed direction (clockwise or counterclockwise) in which the entering sheet 18 is skewed. However, in the system 10, the increased sheet buckle on the side compared to the other side of a skewed sheet being registered automatically determines which direction the baffle 18 pivots, and no pivotal drive system or sheet skew sensing system is required.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet edge registration system with improved sheet deskewing for flimsy print media sheets, in which a sheet moving in a sheet movement direction is partially buckled by at least one edge of said sheet engaging said registration system, wherein a transversely pivotal baffle member is pivotally mounted to overlie at least part of said buckled sheet being buckled by said sheet edge registration system and to at least partially define a sheet buckle chamber for said buckled sheet, said pivotal baffle member being intermediately pivotable about a pivot axis extending generally in said sheet movement direction and generally intermediately of said sheet so as to provide a first side of said pivotal baffle member extending out over at least a substantial portion of one side of said sheet from one side of said pivot axis, and a second side of said baffle member extending out over at least a substantial portion of the opposing side of said sheet from the opposite side of said pivot axis, so that pivotal movement of said second side of said baffle member in a direction away from said sheet is automatically opposite from pivotal movement of said first side of said baffle member in a direction towards said sheet, so that the effective buckle chamber size and sheet path length on one side of said sheet is automatically different from the effective buckle chamber size and sheet path length on the other side of said sheet from said pivoting of said pivotal baffle member, so as to assist in the deskewing of said sheet being partially buckled by said sheet edge registration system.

2. The sheet edge registration system with improved sheet deskewing of claim 1, in which said pivotal baffle member is automatically pivoted in response to the buckling of one side of said sheet more than the buckling of other side of said sheet as said sheet is being partially buckled by said sheet edge registration system.

3. The sheet edge registration system with improved sheet deskewing of claim 1, in which said pivotal baffle member is pivoted by a pivotal drive system controlled by a sheet skew detector.

4. The sheet edge registration system with improved sheet deskewing of claim 1, in which said sheet edge registration system includes plural retractable fixed position sheet edge stop members extending transversely of said sheet movement direction.

5. The sheet edge registration system with improved sheet deskewing of claim 1, in which said sheet edge registration system has plural retractable and extendable fixed position sheet edge stop members extending transversely of said sheet movement direction which are automatically retracted for initial movement of a sheet past said retractable fixed position sheet edge stop members and automatically extended to provide for the buckling of said sheet thereagainst by a reverse movement of said sheet.

6. A sheet registration method with improved sheet deskewing of print media sheets moving in a sheet movement direction wherein said sheet is buckled by engagement of at least one edge of said sheet with a sheet edge registration system, wherein a transversely pivotal baffle member is pivotally mounted to overlie at least a part of said partially buckled sheet being buckled against said sheet edge registration system, said pivotal baffle member being intermediately pivotable about a pivot axis extending generally in said sheet movement direction and intermediately of said sheet to provide a first side of said pivotal baffle member extending out over at least a substantial portion of one side of said sheet from one side of said pivot axis, and a second side of said baffle member extending out over at least a substantial portion of the opposing side of said sheet from the opposite side of said pivot axis, so that pivotal movement of said second side of said baffle member in a direction away from said sheet is automatically opposite from pivotal movement of said first side of said baffle member in a direction towards said sheet, so that the effective buckle chamber size and sheet path length on one side of said sheet is automatically different from the effective buckle chamber size and sheet path length on the other side of said sheet from said pivoting of said pivotal baffle member, so as to assist in the deskewing of said sheet being partially buckled by said sheet edge registration system.

7. The sheet edge registration method with improved sheet deskewing of claim 6, in which said baffle member is automatically pivoted by engagement with the buckling of the one side of said sheet which is more than the buckling of the other side of said sheet.

8. The sheet edge registration method with improved sheet deskewing of claim 6, in which said baffle member is automatically pivoted by a pivotal drive system controlled by detection of the amount of skew of the sheet to be registered.

9. The sheet edge registration method with improved sheet deskewing of claim 6, wherein said sheet edge registration system comprises plural retractable and extendable fixed position sheet edge stop members extending transversely of said sheet movement direction which are automatically retracted for initial movement of a sheet past said retractable fixed position sheet edge stop members and automatically extended for the buckling of said sheet edge thereagainst by a reverse movement of said sheet.

* * * * *